US009151504B2

(12) United States Patent
Lee et al.

(10) Patent No.: US 9,151,504 B2
(45) Date of Patent: Oct. 6, 2015

(54) COOKING APPARATUS AND METHOD OF MANUFACTURING THE SAME

(75) Inventors: Jeong Ho Lee, Seoul (KR); Seong Bin Lee, Seoul (KR); Kyu In Shim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 622 days.

(21) Appl. No.: 12/441,654

(22) PCT Filed: Oct. 10, 2007

(86) PCT No.: PCT/KR2007/004934
§ 371 (c)(1),
(2), (4) Date: Mar. 17, 2009

(87) PCT Pub. No.: WO2008/044866
PCT Pub. Date: Apr. 17, 2008

(65) Prior Publication Data

US 2010/0083945 A1 Apr. 8, 2010

(30) Foreign Application Priority Data

Oct. 10, 2006 (KR) ..... 10-2006-0098344

(51) Int. Cl.
*F24C 15/00* (2006.01)
*C23C 18/12* (2006.01)

(52) U.S. Cl.
CPC ..... *F24C 15/005* (2013.01); *C23C 18/125* (2013.01); *C23C 18/1241* (2013.01); *C23C 18/1254* (2013.01); *C23C 18/1295* (2013.01); *Y10T 29/4935* (2015.01)

(58) Field of Classification Search
CPC . F24C 15/005; C23C 18/125; C23C 18/1241; C23C 18/1254; C23C 18/1295
USPC ..... 126/20, 198, 237 R, 19 R; 428/428, 469; 29/890.03; 427/355
See application file for complete search history.

(56) References Cited

U.S. PATENT DOCUMENTS

| | | | | |
|---|---|---|---|---|
| 3,271,653 | A * | 9/1966 | Wolf | 220/573.2 |
| 3,373,754 | A * | 3/1968 | Squire | 134/58 D |
| 3,987,719 | A * | 10/1976 | Kian | 99/422 |
| 5,396,834 | A * | 3/1995 | Gambini | 99/422 |

(Continued)

FOREIGN PATENT DOCUMENTS

| | | | |
|---|---|---|---|
| EP | 1 391 249 | A1 | 2/2004 |
| WO | WO-99/02463 | A1 | 1/1999 |
| WO | WO-2004/088208 | A1 | 10/2004 |
| WO | WO-2005/044749 | A2 | 5/2005 |

OTHER PUBLICATIONS

Schütze, Joeng, Babayan, Park, Selwyn and Hicks, "The Atmospheric-Pressure Plasma Jet: A Review and Comparison to Other Plasma Sources", IEEE Transactions on Plasma Science, vol. 26, No. Dec. 6, 1998, pp. 1685-1694.*

Lise-Marie Lacroix, Michael Lejeune, Laura Ceriotti, Martin Kormunda, Tarik Meziani, Pascal Colpo, Francois Rossi, Tuneable rough surfaces: A new approach for elaboration of superhydrophobic films, Surface Science, vol. 592, Issues 1-3, Nov. 1, 2005, pp. 182-188.*

*Primary Examiner* — Kenneth Rinehart
*Assistant Examiner* — William Corboy
(74) *Attorney, Agent, or Firm* — Birch, Stewart, Kolasch & Birch, LLP

(57) ABSTRACT

A cooking apparatus is disclosed. The cooking apparatus includes an apparatus body, a cooking chamber defined in the apparatus body for cooking food, and a door for opening and closing the cooking chamber. The cooking chamber has an inner wall surface-treated by plasma.

6 Claims, 3 Drawing Sheets

(56) References Cited

U.S. PATENT DOCUMENTS

| | | | | |
|---|---|---|---|---|
| 5,871,837 | A * | 2/1999 | Adair | 430/124.11 |
| 6,660,363 | B1 * | 12/2003 | Barthlott | 428/141 |
| 7,488,515 | B2 * | 2/2009 | Groll | 427/294 |
| 2003/0138661 | A1 * | 7/2003 | Souchard et al. | 428/689 |
| 2004/0105985 | A1 * | 6/2004 | Henze et al. | 428/426 |
| 2004/0200826 | A1 * | 10/2004 | Boyer et al. | 219/482 |
| 2006/0182929 | A1 * | 8/2006 | Joerdens et al. | 428/141 |
| 2007/0272231 | A1 * | 11/2007 | Ambrose | 126/337 R |
| 2008/0085604 | A1 * | 4/2008 | Hoshino et al. | 438/712 |

* cited by examiner

COOKING APPARATUS AND METHOD OF MANUFACTURING THE SAME

TECHNICAL FIELD

The present invention relates to a cooking apparatus, and more particularly, to a cooking apparatus having improved cleanability and a method of manufacturing the same.

BACKGROUND ART

Generally, a cooking apparatus is represented by products such as a conventional heat oven and a microwave oven. The microwave oven is a type of cooking apparatus used to cook food using only a magnetron or jointly a magnetron and a heater, and the oven is another type of cooking apparatus used to cook food by heating using dry heat hermetically sealed food. Here, electricity or gaseous fuel is used as a heat source.

The cooking apparatus is further represented by, for example, a frying pan and a pot, which have a surface directly contacting food.

The conventional heat oven and/or the microwave oven includes an oven body forming the external appearance thereof, a cooking chamber defining a space for receiving food, a door for opening and closing the cooking chamber, and a heating unit for heating the food in the cooking chamber.

The cooking chamber is a cooking space defined in the oven body. The door is hingedly coupled to the front of the oven body such that the door is opened and closed in the vertical direction and/or in the lateral direction. The heating unit is mounted in the cooking chamber at one side thereof for supplying thermal energy necessary to cook the food. The thermal energy, generated from the heating unit, is transmitted to the food by convection or radiation.

However, the above-described conventional cooking apparatus has the following problems.

First, the conventional cooking apparatus has a problem in that the surface of the cooking apparatus, exposed to the food, does not simultaneously satisfy heat resistance, durability, and cleanability. In the conventional cooking apparatus, enamel is generally used for improving abrasion resistance and heat resistance at the region exposed to the food. However, the food easily sticks to the cooking chamber when the enamel is used to construct the cooking chamber.

Also, Teflon, exhibiting excellent cleanability, may be used to prevent the food from sticking to the cooking chamber. However, Teflon does not satisfy the heat resistance and the abrasion resistance.

Second, when contaminants, such as oil, generated during the cooking of the food, sticks to the inner wall of the cooking chamber, the heating unit is operated at a high temperature, for example at 450° C. or more, for two hours or more to burn the contaminants which are stuck to the inner wall of the cooking chamber. With such an operation, the contaminants are removed from the inner wall of the cooking chamber.

When the interior of the cooking chamber is maintained at such a high temperature for a long period of time, however, the power consumed by the heating unit is greatly increased, and a user is restricted for a period of time from using the cooking apparatus.

Third, the cooking apparatus, such as the conventional oven and/or the microwave oven, has a high-temperature cleaning function to burn the contaminants. Due to the high-temperature cleaning function, however, the temperature of a door glass located at the front of the cooking chamber also increases. The door glass is directly exposed to the user, with the result that the user may suffer a burn by the high-temperature door glass.

Lastly, the higher the internal temperature of the cooking chamber is, the thicker an insulation member for isolating thermal energy leaking from the cooking chamber is. When the thickness of the insulation member is increased, the manufacturing costs of the product are increased as well, and, in addition, the space of the cooking chamber becomes relatively smaller.

DISCLOSURE OF INVENTION

Technical Problem

An object of the present invention devised to solve the problem lies on a cooking apparatus which is capable of simultaneously improving abrasion resistance, heat resistance, and cleanability, and a method of manufacturing the same.

Another object of the present invention devised to solve the problem lies on a cooking apparatus, having a cooking chamber, which is capable of reducing the power consumption and the cleaning time in the cooking chamber, and a method of manufacturing the same.

A further object of the present invention devised to solve the problem lies on a cooking apparatus constructed in a structure in which the space of a cooking chamber is enlarged, and a method of manufacturing the same.

Technical Solution

The object of the present invention can be achieved by providing a cooking apparatus including an apparatus body, a cooking chamber defined in the apparatus body for cooking food, and a door for opening and closing the cooking chamber, wherein the cooking chamber has an inner wall surface-treated by plasma.

Preferably, the cooking apparatus further includes a coating layer formed on the inner wall of the cooking chamber for improving the cleanability at the inner wall of the cooking chamber.

Preferably, the cooking apparatus further includes a coating material filled in etched grooves formed at the inner wall of the cooking chamber by plasma surface treatment.

Preferably, the coating material and a portion of the inner wall of the cooking chamber are simultaneously exposed to the food.

Preferably, the inner wall of the cooking chamber is plasma-etched under atmospheric pressure.

Preferably, the cooking apparatus further includes a tray mounted in the cooking chamber, wherein the surface, including a region where the food is placed, of the tray is plasma-etched.

Preferably, the cooking apparatus further includes a moisture supply unit for supplying steam or water necessary to clean the interior of the cooking chamber after the cooking of the food is completed.

In another aspect of the present invention, provided herein is a cooking apparatus including an apparatus body, a cooking chamber defined in the apparatus body for cooking food, and a door for opening and closing the cooking chamber, wherein the cooking chamber has an inner wall including a parent material, forming the external appearance of the cooking chamber, and a first coating layer formed at the top of the parent material, the first coating layer being surface-treated by plasma.

Preferably, the parent material is made of metal, and the first coating layer is made of enamel.

Preferably, the cooking apparatus further includes a coating material filled in etched grooves formed at the first coating layer.

Preferably, the coating material is solidified in the etched grooves by heat.

Preferably, the coating material contains silicon oil.

Preferably, the cooking apparatus further includes a second coating layer formed at the top of the first coating layer.

Preferably, the second coating layer is made of a coating material exhibiting water repellency.

In a further aspect of the present invention, provided herein is a method of manufacturing a cooking apparatus, including surface-treating a surface to be exposed to food using plasma and coating a coating material for improving cleanability at the surface-treated surface.

Preferably, the step of surface-treating the surface includes forming etched grooves at the surface through a plasma etching process under atmospheric pressure.

Preferably, the step of coating the coating material includes filling the etched grooves with the coating material.

Preferably, the step of coating the coating material includes applying the coating material to the top of the plasma surface-treated surface, the coating material exhibiting water repellency.

Preferably, the coating material contains silicon oil.

Preferably, the method further includes applying heat to the surface to solidify the coating material.

Advantageous Effects

According to the present invention with the above-stated construction, the etched grooves are formed at the inner wall of the cooking chamber or the cooking member through the plasma etching process, and the etched grooves are filled with a coating material exhibiting water repellency. Consequently, the present invention has the effect of providing a cooking apparatus having simultaneously improved abrasion resistance, heat resistance, and cleanability.

Also, it is not necessary to heat the interior of the cooking chamber to high temperature so as to remove/clean contaminants and/or residue, if the cooking apparatus having the cooking chamber is a gas oven or a microwave oven. Consequently, it is possible to reduce the thickness of an insulation member for insulating the cooking chamber, whereby the cooking chamber can be structured to have more space.

Also, it is not necessary to maintain the interior of the cooking chamber at a high temperature, such that contaminants (or food residue), sticking to the inner wall of the cooking chamber, are burned (or heated to a high temperature), when the cooking apparatus having the cooking chamber is a gas oven or a microwave oven. Consequently, a possibility of burning (or increasing to high temperature) is lowered, and power consumption is reduced. Furthermore, it is possible to reduce time necessary to clean the cooking chamber because it is not necessary to maintain the interior of the cooking chamber at a high temperature for a long period of time, such that the contaminants are burned.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

MODE FOR THE INVENTION

Reference will now be made in detail to the preferred embodiments of the present invention, examples of which are illustrated in the accompanying drawings.

Figure 1:
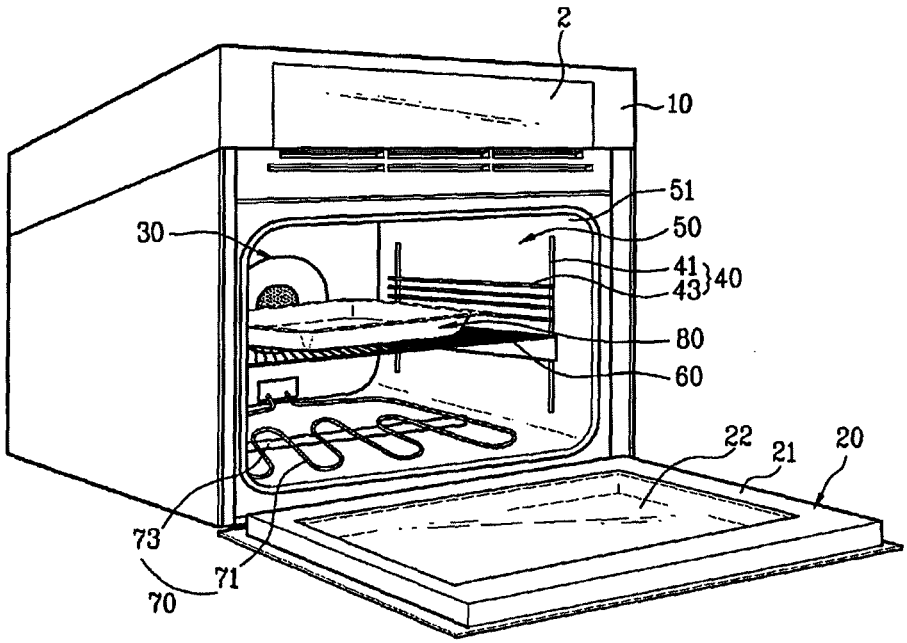
FIG. 1 is a perspective view illustrating an embodiment of a cooking apparatus according to the present invention.

Hereinafter, an embodiment of a cooking apparatus according to the present invention will be described in detail with reference to FIG. 1.

The cooking apparatus includes an apparatus body 10, a cooking chamber 50 defining a space for cooking food, a door 20 for opening and closing the cooking chamber 50, a control unit (not shown) for controlling the apparatus body 10, and a heating unit for heating the food.

The apparatus body 10 is provided at the upper front thereof with a control panel 2 for controlling the cooking apparatus. The control panel 2 is connected to the control unit, mounted in the apparatus body 10. Alternatively, the control panel 2 may be provided separately from the apparatus body 10 such that the control unit can be remotely controlled.

In the apparatus body 10 is also mounted a transformer (not shown) for supplying power depending on the food type. The transformer is connected to the control unit such that the transformer can be controlled by a user. For example, when the user selects a food cooking mode through the control panel 2, the control unit, connected to the control panel 2, controls the transformer to adjust power supplied to the heating unit.

The heating unit may be exposed in the cooking chamber 50 or mounted in the apparatus body 10. A thermal energy, generated from the heating unit, is transmitted to the food by convection or radiation.

The heating unit includes a first heating unit (not shown) mounted at the top of the cooking chamber 50, a second heating unit 30 mounted at the rear of the cooking chamber 50, and a third heating unit 70 mounted at the bottom of the cooking chamber 50.

The first heating unit emits infrared rays to heat the food. The first heating unit is used mainly to broil food. A magnetron or a heater is used as the first heating unit. The first heating unit is preferably fixedly mounted to the top of the cooking chamber 50. Alternatively, the first heating unit may be movably mounted to the top of the cooking chamber 50.

The second heating unit 30 is located at the inner wall of the cooking chamber 50 opposite to the door 20 for auxiliary supplying thermal energy to food placed in the cooking chamber 50. Around the second heating unit 30 is mounted a blowing fan (not shown) for blowing heat, generated from the second heating unit 30, into the cooking chamber 50. The blowing fan serves to uniformly distribute air, heated by the second heating unit, in the cooking chamber 50.

The third heating unit 70 includes a heat generating member 71 for generating heat and a supporting member 73 for supporting the heat generating member 71. The third heating unit 70 is located below a rack 60 mounted in the cooking chamber 50. The third heating unit 70 may serve as a heat source for baking breads and cakes.

A space heated by the third heating unit 70 may not be defined as the entire interior space of the apparatus body 10 but only as a space for baking the breads and the cakes.

For example, the cooking chamber 50 may be divided into two cooking chamber sections by an additional partition (not shown), and the third heating unit may heat one of the cooking chamber sections. In conclusion, the first, second, and third heating units are selectively turned on/off, depending upon the food cooking mode, to transmit thermal energy to the food.

Further, a tray 80, on which food is placed, may be mounted in the cooking chamber 50. The tray 80 is detachably mounted to the rack 60, which guides the tray 80. Alternatively, the tray 80 may be fixedly mounted in the cooking chamber 50. Also, the surface, including a region where the food is placed, of the tray 80 may be plasma-etched.

Etched grooves are formed at the surface of the tray 80 by the plasma etching. The etched grooves are filled with a coating material exhibiting water repellency, i.e., a non-hydrophilic property.

Consequently, contaminants or food residue, sticking to the tray 80 after the food is cooked, are easily removed from the tray 80. The plasma etching process will be described in detail below.

As described above, the rack 60, on which the tray 80 is placed, is mounted in the cooking chamber 50. Alternatively, food may be directly placed on the top of the rack 60. The rack 60 may be mounted depending upon the intension of a user. Specifically, the rack 60 may be mounted such that the position of the rack 60 can be adjusted in the apparatus body 10.

At opposite sides of the rack 60 are mounted rack supporters 40 for supporting the rack 60. Each rack supporter 40 includes a plurality of rack guides 43 for supporting the rack 60 and guide supporting members 41 for supporting the rack guides 43. The guide supporting members 41 are fixedly mounted to the inner surface of the apparatus body 10. The rack guides 43 are mounted to the guide supporting members 41 in a multi-stage fashion.

The door 20, which opens and closes the apparatus body 10, is hingedly coupled to the front of the apparatus body 10. The door 20 may be slidably mounted to the front of the apparatus body 10.

The door 20 includes a door frame 21 forming the edge of the door 20 and a door glass 22 mounted in the door frame 21. The bottom of the door frame 21 is hingedly coupled to the apparatus body 10. At the inside edge of the door frame 21 may be mounted a sealing member (not shown) for isolating the inside and outside of the apparatus body 10 from each other. The door glass 22 is preferably made of a transparent material having a heat resistance such that a user can look into the apparatus body 10 through the door glass 22.

On the other hand, the cooking chamber 50 is located in the apparatus body 10 such that a predetermined space for cooling food is defined by the inner wall of the cooking chamber. A method of processing the inner wall of the cooking chamber 50 will be described below.

In the apparatus body 10 may be further mounted a moisture supply unit (not shown) for supplying water or steam necessary to clean the interior of the cooking chamber 50 after the cooking of food is completed.

The moisture supply unit includes a water tank for storing water, a pump for pumping the water, stored in the water tank, into the cooking chamber 50, and a water spray nozzle for spraying water to the inner surface of the cooking chamber 50. Alternatively, the moisture supply unit may include a water tank for storing water, a heat er for heating the water into steam, and a steam spray nozzle for spraying the steam to the inner surface of the cooking chamber 50.

The moisture supply unit sprays water and/or steam to the inner surface of the cooking chamber 50, which exhibits water repellency or super water repellency through the plasma surface treatment, to remove contaminants or food residue, sticking to the inner wall of the cooking chamber 50.

A plasma processing device is used to plasma-etch the inner wall of the cooking chamber 50 or a coating layer formed at the inner wall of the cooking chamber 50.

The plasma processing device generates plasma at atmospheric pressure and etches the surface of a substrate using the generated plasma. The inner wall or the coating layer may be plasma-etched in a vacuum state.

Hereinafter, the plasma processing device, which is used to manufacture the cooking apparatus according to the present invention, will be described briefly with reference to FIG. 2.

Plasma includes positive charge ions and negative charge electrons are gathered as a group. In the plasma, the number of the ions is approximately equal to the number of the electrons, and therefore, the plasma generally exhibits electrical neutrality.

A principle of generating the plasma will be described briefly below. If energy is applied to a gas particle (i.e., a gas molecule or a gas atom), the outermost electron goes out of orbit. At this time, the gas particle is divided into a positive charge ion and a negative charge electron, and therefore, the gas particle is changed into a charged particle exhibiting an electric charge. Such positive charge ions and negative charge electrons are gathered as a group.

Generally, an artificial plasma phenomenon occurs in a space as follows. Electrons generated by electric energy or free electrons in the space are accelerated by an electric field, and collide with gas particles in the space. As a result, an ionization reaction occurs, and therefore, the plasma is formed.

Specifically, when an atmospheric gas is supplied between two electrodes under atmospheric pressure, and then high frequency, i.e., radio frequency (RF), is supplied between the two electrodes, the gas emits light. That is, when an electric discharge is performed using a high frequency resonance phenomenon, glow charge occurs. It is possible to considerably lower the temperature of the glow charge as compared to an atmospheric pressure discharge, which is performed by a different method.

The plasma etching process means a surface treatment to remove or tear off a specific material, such as silicon, using a specific atmospheric gas, for example, oxygen ($O_2$) or carbon tetrafluoride ($CF_4$). Specifically, it is possible to remove an unnecessary matter or an unnecessary part from an object to be processed through the collision or coupling of particles, generated by the plasma, with the surface of the object.

Figure 2:
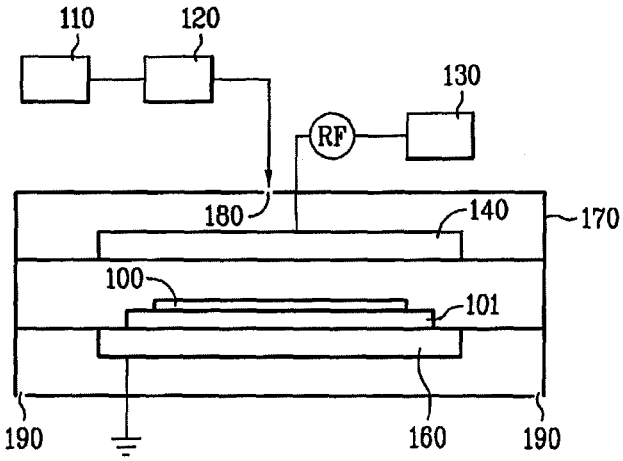
FIG. 2 is a view illustrating an embodiment of an atmospheric pressure plasma processing device used to manufacture the cooking apparatus according to the present invention.

The plasma processing device, shown in FIG. 2, is a device for generating plasma at atmospheric pressure. Hereinafter, the plasma processing device will be referred to as an "atmospheric pressure plasma processing device."

The atmospheric pressure plasma processing device includes a chamber 170 having a gas inlet port 180 and a gas outlet port 190, a stage 101 disposed in the chamber 170 such that a substrate 100 is mounted on the stage 101, and first and second electrodes 140 and 160 opposite to each other, the first electrode 140 being spaced a predetermined distance from the stage 101, the second electrode 160 being mounted to the surface of the stage 101.

Outside the chamber 170 are mounted a radio frequency (RF) power supply unit 130 for applying high frequency to the first electrode 140 and a gas supply unit 110 for supplying an atmospheric gas through the gas inlet port 180. Between the gas inlet port 180 and the power supply unit 130 is mounted a filter 120 for filtering the atmospheric gas.

The second electrode 160 is grounded, and the surfaces of the first and second electrodes 140 and 160 are protected by an insulative member (not shown). The gas outlet port 190 serves as a passage through which gas left after the plasma surface treatment on the substrate 100 is discharged.

The power supply unit 130 is operated such that the voltage applied between the two electrodes is 100 to 90,000V and the frequency is 10 to $10^9$ Hz. The atmospheric gas, introduced through the gas inlet port 180, activated between the electrodes, which may be constructed in various forms, to form plasma including ions, electrons, radicals, and neutrons. Alternatively, the atmospheric gas may be preheated to a predetermined temperature level, and is then introduced into the chamber 170.

The gas may be at least one selected from a group consisting of an inert gas, an oxidative gas, and a reducing gas. Specifically, the gas includes air, nitrogen ($N_2$), oxygen ($O_2$), argon (Ar), water ($H_2O$), helium (He), carbon dioxide ($CO_2$), nitric oxide, carbon tetrafluoride, ammonia, ethylene, and ethylene chloride, which are mixed or individually used.

It is preferable to uniformly supply the atmospheric gas throughout the chamber such that the electric charge is maintained in a large area. In the chamber 170 may be mounted a mesh, through which the atmospheric gas, introduced through the gas inlet port 180, is uniformly distributed in the chamber 170.

The electrodes 140 and 160 are made of a material having high corrosion resistance and conductivity, such as aluminum, titanium, nickel, chrome, copper, tungsten, or platinum. A dielectric may be mounted to the bottom of each electrode. If the electric charge is difficult to achieve or a strong electric charge is needed, the size of the dielectrics may be adjusted to induce a desired electric charge necessary to generate plasma.

Hereinafter, the operation of the atmospheric pressure plasma processing device will be described in detail. The substrate 100 is located on the second electrode 160. Gas is supplied into the chamber 170 from the gas supply unit 110 through the filter 120. At the same time, high frequency is applied to the first electrode 140. As a result, the atmospheric gas between the first and second electrodes 140 and 160 is changed into plasma.

If electric energy is applied to molecules of the atmospheric gas existing in the chamber 170, the outermost electrons of the molecules or atoms go out of orbit, due to the collision between accelerated electrons, with the result that ions or radicals having high reactivity are generated. The generated ions or radicals are accelerated due to the continuous collision between the ions or the radicals and an electrically attractive force. Consequently, the ions or the radicals collide with the surface of a material, with the result that the molecular coupling is broken at a region having a size of less than a few micrometers, whereby the inner surface of the substrate is cut out by a predetermined thickness or a minute concavo-convex part is formed at the surface of the substrate.

At this time, the substrate etching degree may be changed depending upon an ingredient of the atmospheric gas supplied from the gas supply unit 110, the intensity and waveform of the high frequency applied to the first electrode 140, and the temperature of the substrate.

Furthermore, only a specific region of the substrate 100 may be plasma-etched. For example, a mask is mounted on the remaining area of the substrate 100, excluding the area to be etched, such that the plasma etching process is performed to the area of the substrate 100 excluding the mask. At this time, minute particles, generated during the plasma etching process, may be suctioned by an additional suction unit (not shown).

Hereinafter, various embodiments of an inner wall of the cooking chamber plasma-etched by the plasma processing device will be described with reference to FIGS. 3 to 6.

Figure 3:
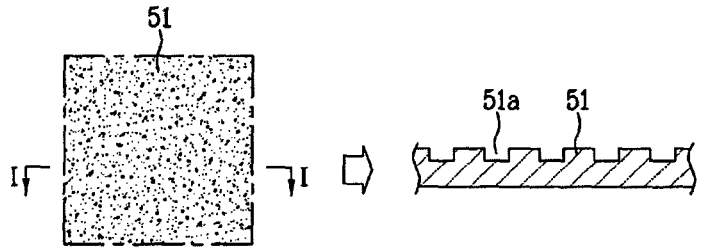
FIG. 3 is a view illustrating the inner wall of a cooking chamber plasma-etched according to the present invention.

Referring to FIG. 3, the inner wall 51 of the cooking chamber is plasma-etched. More specifically, FIG. 3 illustrates an example in which a parent material (e.g., metal) is plasma-etched to be used as the inner wall of the cooking chamber. If the inner wall of the cooking chamber is plasma-etched, surface irregularities, i.e., etched grooves 51*a*, are formed at the surface of the inner wall of the cooking chamber.

The inner wall 51 of the cooking chamber is plasma-etched at atmospheric pressure. The surface of the inner wall 51 of the cooking chamber is etched per micro unit area. The physical properties of the inner wall 51 of the cooking chamber are decided depending upon surface treatment conditions including atmospheric gas supplied during the plasma etching process, and voltage and pressure applied during the plasma etching process.

The parent material, forming the inner wall 51 of the cooking chamber, may be made of metal or enamel. At the inner wall 51 of the cooking chamber is also formed a coating layer 53 for improving the cleanability at the inner wall 51 of the cooking chamber, as shown in FIGS. 4 and 5.

Figure 4:
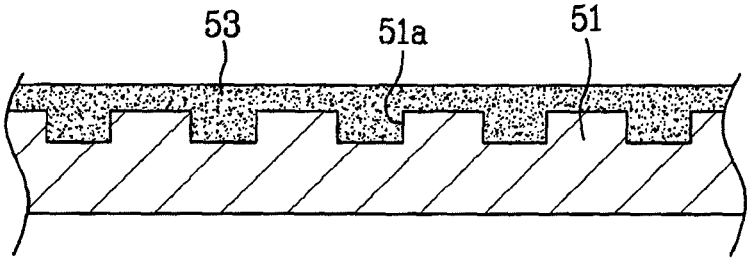
FIG. 4 is a view illustrating the inner wall of the cooking chamber, located in the cooking apparatus of FIG. 1, to which a coating process is carried out according to a first embodiment of the present invention.
Figure 5:
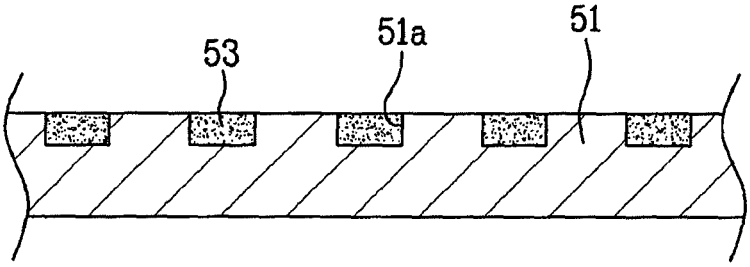
FIG. 5 is a view illustrating the inner wall of the cooking chamber, located in the cooking apparatus of FIG. 1, to which a coating process is carried out according to a second embodiment of the present invention.

Specifically, the coating layer 53 may be formed at the entire surface of the inner wall 51 of the cooking chamber, including the etched grooves 51*a* formed at the inner wall 51 of the cooking chamber (see FIG. 4). Alternatively, as shown in FIG. 5, the coating layer 53 may be formed in the etched grooves 51*a* formed at the inner wall 51 of the cooking chamber in such a manner that the etched grooves 51*a* are filled with the coating layer 53.

After the coating layer 53 is formed at the inner wall 51 of the cooking chamber, the coating layer 53 is solidified by heat. Specifically, a coating material, forming the coating layer 53, may be solidified while the etched grooves 51*a* are filled with the coating material. Alternatively, the coating material may be solidified while the coating material is applied to the entire surface of the inner wall 51 of the cooking chamber, including the etched grooves 51*a*. The temperature to solidify the coating material is changed depending upon the heat resistance of the coating material.

The coating material includes a material exhibiting water repellency, i.e., a non-hydrophilic property. Especially, the coating material may include a silicon oil. The following chemical formula 1 represents a silicon oil used in the present embodiment.

[Chemical formula 1]

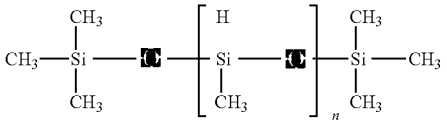

The silicon oil is a liquid-phase silicon resin having a relatively low degree of polymerization. Also, the silicon oil has no taste and smell. The silicon oil has a low solidifying point, and the change in viscosity of the silicon oil depending upon the change of the temperature is small. In addition, the silicon oil exhibits water repellency. In other words, the silicon oil has no hydrophilic property. Specifically, the surface tension of the silicon oil is very small as compared to ordinary solvents, and therefore, the silicon oil exhibits water repellency. Consequently, if oil, generated during the cooking of food, is attached to the surface of the silicon oil, the oil can be easily removed.

For example, when dimethyl silicon oil is solidified to the surface of an enamel by heating or the like, the surface of the enamel exhibits water repellency. Here, a methyl group means a monovalent group (—$CH_3$) that is derived from methane ($CH_4$) by removal of a hydrogen atom (H). Also, the silicon oil has a low combustibility, and therefore, the safe use of the silicon oil is possible. In addition, the silicon oil is physiologically inert, and therefore, the silicon oil is harmless to a human body. Furthermore, the silicon oil is extremely stable against oxidation in the air.

Further, even when the silicon oil coexists with acid or alkali, the silicon oil is hardly affected by the acid or the alkali, if the percentage of the alkali is less than 10% or the percentage of the acid is less than 30%. Furthermore, the silicon oil is chemically inert, and therefore, the silicon oil hardly corrodes metal. Also, the silicon oil has a high heat resistance of 300 to 1000° C.

The contact angle between the inner wall of the cooking chamber, the surface of which is coated with the silicon oil, and a water drop is approximately 90 to 150 degrees. That is, the inner wall of the cooking chamber exhibits water repellency. According to the plasma etching condition, the inner wall of the cooking chamber may exhibit super water repellency in which the contact angle between the inner wall of the cooking chamber and the water drop exceeds 150 degrees.

Figure 6:
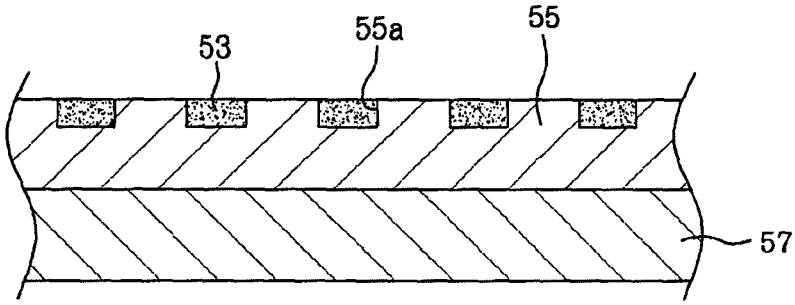
FIG. 6 is a view illustrating the inner wall of the cooking chamber, located in the cooking apparatus of FIG. 1, to which a coating process is carried out according to a third embodiment of the present invention.

Referring to FIG. 6, a first coating layer 55, made of enamel, is formed on a parent material 57, such as metal, and the first coating layer 55 is plasma-etched. In this embodiment, a second coating layer 53 is further formed on the first coating layer 55.

A first coating material, forming the first coating layer 55, and a second coating material, forming the second coating layer 53, may be directly exposed to food during the cooking of the food. The first coating material increases abrasion resistance at the inner wall of the cooking chamber, and the second coating material increases cleanability at the inner wall of the cooking chamber.

At the plasma-etched first coating layer 55 are formed etched grooves 55*a* of a predetermined shape. The etched grooves 55*a* are filled with the second coating material, with the result that the second coating layer 53 is formed on the first coating layer 55.

Alternatively, the second coating layer 53 may be formed on the entire surface of the first coating layer 55 such that the second coating layer 53 fully covers the first coating layer 55. Also, a coating material exhibiting water repellency, i.e., a non-hydrophilic property, may be used as the second coating material as in the previous embodiments.

Figure 7:
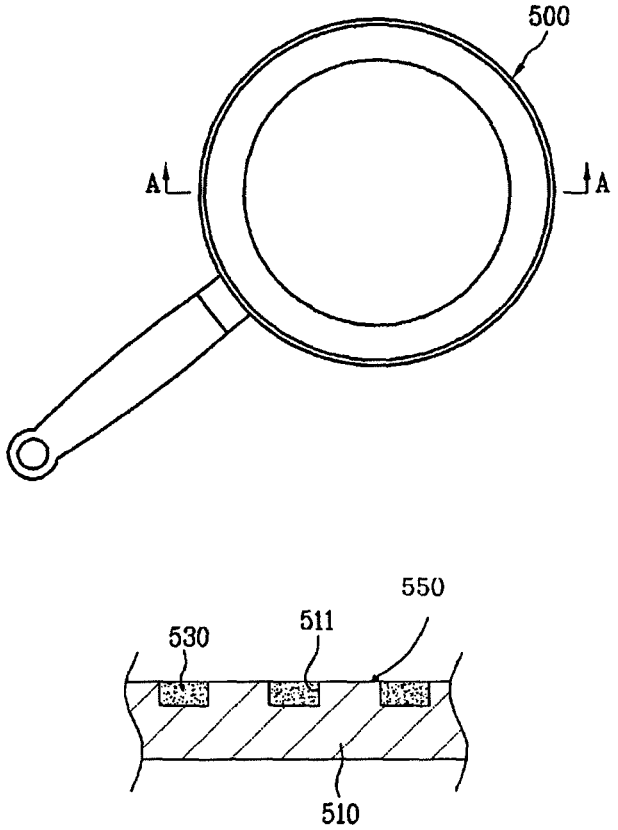
FIG. 7 is a view illustrating another embodiment of a cooking apparatus according to the present invention.

Hereinafter, the coated state of a cooking member included in another embodiment of a cooking apparatus 500 according to the present invention will be described with reference to FIG. 7.

The cooking apparatus according to this embodiment includes a cooking member and a coating layer 550 formed at the top of the cooking member. The cooking apparatus 500 includes various kinds of cooking devices having a surface exposed to food. For example, the cooking apparatus 500 includes a frying pan, a pot, and a rice cooker.

The coating layer 550 includes a first coating material 510, which is plasma-etched, and a second coating material 530 filled in etched grooves 511, formed at the first coating material 510. The first coating material 510 may be enamel, and the second coating material 530 may contain silicon oil.

The second coating material 530 is solidified in the etched grooves 511 by heat. The temperature to solidify the second coating material 530 is changed depending upon the heat resistance of the silicon oil.

Figure 8:
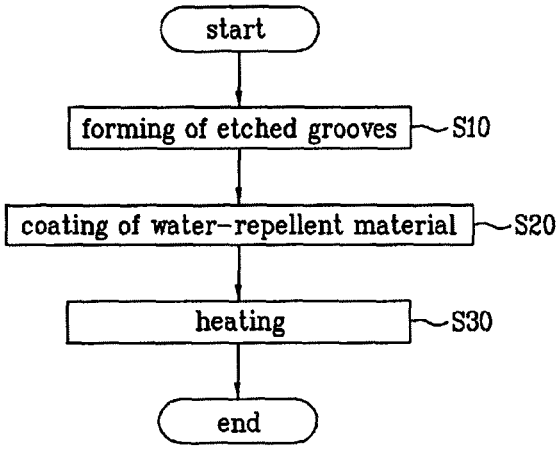
FIG. 8 is a flow chart illustrating an embodiment of a method of manufacturing a cooking apparatus according to the present invention.

Hereinafter, a method of manufacturing the cooking apparatus according to the present invention will be described with reference to FIG. 8.

A manufacturer forms etched grooves at a parent material, such as enamel, the surface of which is exposed to food, i.e., the inner wall of a cooking chamber or a cooking member, through plasma surface treatment (S10). The depth or number of the etched grooves may be changed according to a plasma etching condition.

Here, the plasma etching condition includes an ingredient of atmospheric gas supplied during the plasma etching process, the intensity and waveform of high frequency applied to the plasma processing device, and the temperature of the substrate.

Subsequently, the manufacturer applies a coating material, exhibiting water repellency, to the inner wall of the cooking chamber or to the surface of the cooking member, i.e., in the etched grooves (S20). Here, the coating material may contain silicon oil.

Subsequently, the manufacture applies heat to the coating material, filled in the etched grooves, such that the coating material is solidified (S30). As a result, the inner wall of the cooking chamber or the cooking member exhibit abrasion and heat resistance, which are provided by the enamel, and, at the same time, the inner wall of the cooking chamber or the cooking member exhibit water repellency. Consequently, the cleanability at the inner wall of the cooking chamber or to the surface of the cooking member is improved. Here, the temperature to heat the inner wall of the cooking chamber or the cooking member, to which the coating material is applied, may be decided depending upon the kind of the coating material.

The present invention is not limited to the above-described embodiments. For example, the inner wall of the cooking chamber may include a parent material, such as metal, forming the shape of the cooking chamber and a coating layer, made of enamel, applied to the top of the parent material.

In this case, the coating layer may be plasma-etched, and etched grooves, formed at the coating layer, may be filled with a coating material exhibiting water repellency. As a result, the coating layer, exposed to food, simultaneously exhibits abrasion resistance, which is provided by the enamel, and water repellency, which is provided by the coating material.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The cooking apparatus and the method of manufacturing the same according to the present invention have the following effects.

First, according to the present invention, the etched grooves are formed at the inner wall of the cooking chamber or the cooking member through the plasma etching process, and the etched grooves are filled with a coating material exhibiting water repellency. Consequently, the present invention has the effect of providing a cooking apparatus having simultaneously improved abrasion resistance, heat resistance, and cleanability.

Second, according to the present invention, it is not necessary to heat the interior of the cooking chamber to high temperature, such that the interior of the cooking chamber is cleaned, when the cooking apparatus having the cooking chamber is a gas oven or a microwave oven. Consequently, it is possible to reduce the thickness of an insulation member for insulating the cooking chamber, whereby the cooking chamber is structured to have more space.

Third, according to the present invention, it is not necessary to maintain the interior of the cooking chamber at a high temperature, such that contaminants or food residue, sticking to the inner wall of the cooking chamber, are burned, when the cooking apparatus having the cooking chamber is a gas oven or a microwave oven. Consequently, a possibility of burning is lowered, and power consumption is reduced. Furthermore, it is possible to reduce time necessary to clean the cooking chamber because it is not necessary to maintain the interior of the cooking chamber at a high temperature for a long period of time, such that the contaminants or food residue are burned.

The invention claimed is:

1. A cooking apparatus, comprising:

a body;

a cooking chamber formed in the body, the cooking chamber having an inner surface;

a door for opening and closing the cooking chamber;

a base material comprising a metal and forming an exterior of the cooking chamber;

a first coating material comprising an enamel coated on the base material to form a first coating;

a plurality of etched grooves formed on the first coating; and a second coating material exhibiting water repellency applied into the etched grooves to fill the etched grooves and solidified by heating to form a second coating, wherein both the first coating and the second coating simultaneously form the inner surface of the cooking chamber and are simultaneously exposed to food on the inner surface, thereby increasing abrasion resistance by the first coating and cleanability by the second coating.

2. The cooking apparatus of claim 1, wherein the etched grooves are formed by plasma etching.

3. The cooking apparatus of claim 1, wherein the second coating material comprises silicone oil.

4. The cooking apparatus of claim 1, further comprising:

a tray, the tray having an upper surface;

etched grooves formed in the upper surface of the tray by plasma etching; and the first or second coating material applied to the upper surface of the tray.

5. The cooking apparatus of claim 1, further comprising a moisture supply unit for supplying steam or water necessary to clean the inner surface of the cooking chamber after the cooking of the food is completed.

6. The cooking apparatus of claim 1, wherein the first coating has a first predetermined thickness, and wherein the etched grooves are formed in a regular pattern and have a first predetermined depth, the first predetermined depth being less than the first predetermined thickness.

* * * * *